United States Patent [19]

Badrock

[11] 4,336,016

[45] Jun. 22, 1982

[54] BURNERS

[75] Inventor: John Badrock, Southport, England

[73] Assignee: World Stress (Gas Contracts) Limited, St. Helens, England

[21] Appl. No.: 115,108

[22] Filed: Jan. 24, 1980

[30] Foreign Application Priority Data

Jan. 26, 1979 [GB] United Kingdom ..... 7902764

[51] Int. Cl.[3] ..... F23M 9/00

[52] U.S. Cl. ..... 431/158; 431/182; 431/285; 431/353

[58] Field of Search ..... 431/158, 353, 352, 174, 431/349, 182, 187, 188, 283, 285, 350, 354

[56] References Cited

U.S. PATENT DOCUMENTS

| | | | |
|---|---|---|---|
| 1,874,488 | 8/1932 | Franklin | 431/178 |
| 2,462,704 | 2/1949 | Zink | 431/349 |
| 3,016,703 | 1/1962 | Lorett et al. | 431/158 |
| 3,265,114 | 8/1966 | Childree | 431/285 |
| 3,685,950 | 8/1972 | Nomaguchi et al. | 431/350 |
| 3,700,376 | 10/1972 | Niepenberg et al. | 431/188 |
| 3,737,281 | 6/1973 | Guth | 431/352 |
| 4,105,393 | 8/1978 | Boylett | 431/158 |

FOREIGN PATENT DOCUMENTS

| | | |
|---|---|---|
| 1140561 | 1/1969 | United Kingdom . |
| 1246126 | 9/1971 | United Kingdom . |
| 1306447 | 2/1973 | United Kingdom . |
| 1314971 | 4/1973 | United Kingdom . |
| 1343398 | 1/1974 | United Kingdom . |
| 1414684 | 11/1975 | United Kingdom . |

*Primary Examiner*—Samuel Scott
*Assistant Examiner*—Lee E. Barrett
*Attorney, Agent, or Firm*—Sandler & Greenblum

[57] ABSTRACT

A high velocity gas burner has a housing divided by a partition into an air plenum and a combustion zone. Air is introduced into the plenum with a swirl. A ring of gas jets penetrate the partition through clearance holes. Each jet has a collar tending to impede air flow through the respective hole and the partition is axially displaceable relative to the collars. The partition is preferably cup-shaped with a skirt extending along the housing into the combustion zone so that secondary or excess air can bypass the combustion proper and cool the combustion products to the desired usable temperature.

6 Claims, 2 Drawing Figures

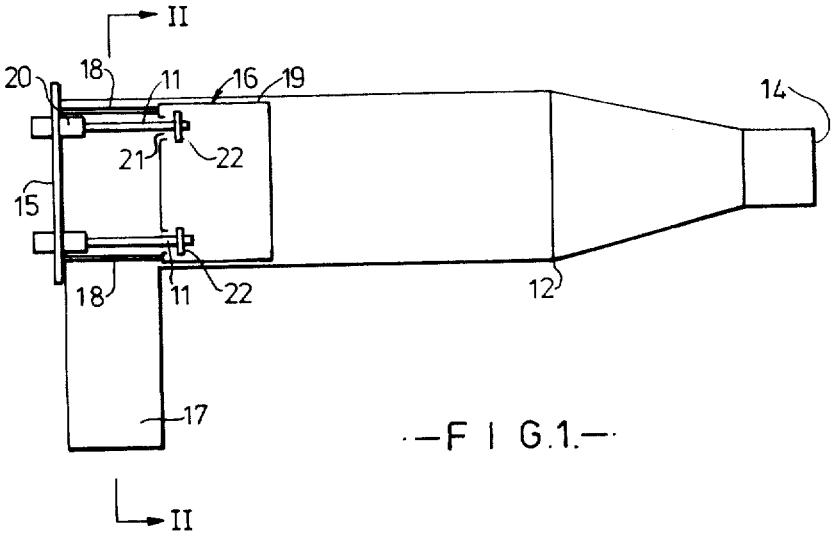
—FIG.1.—
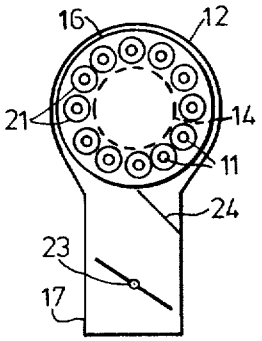
—FIG.2.—

BURNERS

The present invention concerns industrial burners for delivering a high velocity jet of combustion products which would distribute itself by virture of its momentum throughout a confined space.

Such burners are known and usually consist of a central single gas jet with means for introducing combustion air around the gas jet in a combustion chamber having a restricted outlet for the combustion products. There is considerable back pressure built up in the combustion chamber and the potential energy in the pressure is converted into the kinetic energy of the high velocity jet. Thus the gas and the air have to be supplied at sufficient pressure to overcome the back pressure. The gas is often bottled gas and the burners can be used to anneal structures after erection but burners of this type are also used to heat up furnaces; where mains gas is available it can be used. When producing a range of burners of differing heat outputs it is necessary to design the jet and the air introduction means for each size of burner. The present invention aims at providing a design whereby scaling up or down is rendered simpler.

According to the present invention, there is provided an industrial gas burner comprising a cylindrical housing, an air inlet to one end of the housing so arranged that the air enters trangentially resulting in the incoming air swirling, a partition dividing the housing into an air plenum and a combustion zone, and a ring of gas jets penetrating the partition with a clearance around each jet for the supply of primary combustion air from the plenum to the combustion zone.

There can be a gap or gaps between the edge of the partition and the wall of the housing for the supply of secondary air from the plenum.

Since varying heat outputs can be obtained by varying the number of individual jets, a standard jet can be used throughout the range of sizes. Since a plurality of jets are used in each burner, the need to get an intimate mixture of gas and air is less than if a single jet was used.

It is preferred that the clearance around each jet passes air slightly in excess of the stoichometric amount required for combustion of the gas from that jet. Since normally combustion products resulting from combustion at near stoichometric conditions are too hot for annealing purposes, the temperature is lowered by excess air which is conveniently introduced as secondary air around the edge of the partition. The partition is preferably cup-shaped so that the secondary air enters the combustion zone downstream of the actuai combustion and so does not interfere with this. The swirl of the air tends to anchor this secondary air to the wall of the housing not only divorcing the combustion from being affected by the secondary air but cooling the wall as well. It is possible to make the clearances effectively adjustable during installation by having a collar on each jet and having the partition axially adjustable relative to the jets so that adjustment causes each collar to obstruct to a greater or lesser extent the respective clearance. If the collars are on the combustion side of the partition, the collars tend to direct the primary air outwardly momentarily aiding the tendency for the gas to spread leading to improved mixing when the combined jet re-converges.

An embodiment of the present invention will now be described, by way of example, with reference to the accompanying drawings, in which:

FIG. 1 is a schematic axial section through a burner according to the present invention, and FIG. 2 is a section on line II—II of FIG. 1.

The burner illustrated is rated at 6,000,000 B.T.U.'s per hour and comprises a ring of twelve 500,000 B.T.U. gas jets 11 equally spaced apart about the axis of a stepped cylindrical combustion chamber housing 12. This housing is of constant diameter for the greater part of its length but tapers down to a smaller diameter discharge end 14. At the inlet end, the housing is closed off by a bolted-on plate 15 serving as a mounting plate for the jets and for a partition 16 dividing the housing into a combustion air plenum and a combustion zone. An air inlet 17 leads into this entry end of the housing within the plenum. The partition is mounted on the plate by six threaded bars 18 so the partition is axially adjustable and is cup-shaped with a skirt 19 projecting along the housing away from the plate 15. The jets are connected together by a manifold 20 on the plate and project sufficiently far as to penetrate with clearance holes 21 in the partition. Each jet has a collar 22 preferably able to pass through the hole 21 and impeding air flow through the hole. The air inlet 17 has an air control butterfly valve or other control 23 which can be preset and/or coupled with a valve (not shown) regulating the gas supply and is arranged as by means of a baffle 24 to guide the air in tangentially with a swirl to the plenum. The clearances around the jets as effectively reduced by the collars are designed to allow just more than the stoichometric amount of air to the respective jets. The clearance between the skirt and the wall of the housing could pass as much air again for example. Only a single ignition electrode and flame failure device need be provided since the swirl of the air passing through the holes induces cross-ignition of the various jets. Each gas jet consists of a stainless steel tube with a 4mm hole in its discharge end and with two rings, each of four smaller stabilising 2.5 mm holes in the side of the tube at that end, with the first ring say 1 cm from the very end and the other ring a further 2cm back with the collar a further 1 cm back. An oil lance can be incorporated in the burner on the central axis; since this would involve a further hole in the partition, it might be necessary to make this hole tight about the lance or adjust the other effective clearances.

One way of adjusting the effective clearances for the primary air around each gas jet is to axially adjust the partition relative to the collars so that the collars impede flow through the holes to a greater or lesser extent. Adjustment of the secondary or excess air entails replacing the partition with one giving a smaller or lesser gap between its edge and the wall of the housing. The collars have a beneficial effect on combustion if they are on the combustion side of the partition; in simple terms, the air flow is momentarily deflected sideways away from the jet tending to suck the gas along with it and then returns to its original path along with the gas which is thus mixed into the air.

I claim:

1. An industrial gas burner comprising a substantially cylindrical housing having one tapered end through which combustion products are discharged and having a closed second end, a partition axially dividing said housing into an air inlet plenum adjacent said closed end and a combustion chamber adjacent said discharge end, an air inlet arranged transversely to said plenum and comprising means for conducting air tangentially into said plenum and in a swirling fashion around the axis of said housing, said partition including a ring having a plurality of holes, a gas jet nozzle positioned within each of said holes with a clearance between each of said nozzles and a respective one of said holes, a collar disposed about each nozzle and within said combustion chamber, said clearances comprising means for conducting swirling air from said plenum into said combustion chamber, said collars obstructing said clearances and comprising means for directing air outwardly, away from the nozzles, thereby permitting gas from said jet nozzles to spread, said nozzles and said partition being mounted to said housing.

2. A burner in accordance with claim 1 wherein each of said nozzles is substantially tubular.

3. A burner in accordance with claim 2 further comprising adjustable mounting means positioned between said closed second housing end and said partition, said adjustable mounting means adapted to axially displace said partition to regulate air flow simultaneously through all of said clearances.

4. A burner in accordance with claim 1 wherein said partition includes a skirt portion which projects into said combustion chamber and away from said air inlet, a clearance existing between said skirt and said housing.

5. A burner in accordance with claim 3 wherein said adjustable mounting means comprise threaded screws connected to said partition which are adapted to regulate the size of the clearances between said nozzles and said holes by moving said partition relative to said collars.

6. An burner in accordance with claim 1 wherein said nozzles and said partition are independently mounted to said housing.

* * * * *